US006922192B2

(12) United States Patent
Wang

(10) Patent No.: US 6,922,192 B2
(45) Date of Patent: Jul. 26, 2005

(54) WIDE-RANGE AND BALANCED DISPLAY POSITION ADJUSTMENT METHOD FOR LCD CONTROLLER

(75) Inventor: Ming-Hung Wang, Hsin-Chu (TW)

(73) Assignee: Etron Technology, Inc., Hsin-Chu (TW)

( * ) Notice: Subject to any disclaimer, the term of this patent is extended or adjusted under 35 U.S.C. 154(b) by 244 days.

(21) Appl. No.: 10/293,578

(22) Filed: Nov. 13, 2002

(65) Prior Publication Data

US 2004/0090447 A1 May 13, 2004

(51) Int. Cl.[7] ..... G09G 5/00

(52) U.S. Cl. ..... 345/213; 345/667; 345/698; 345/699

(58) Field of Search ..... 345/208–213, 345/667, 698, 699

(56) References Cited

U.S. PATENT DOCUMENTS 4,563,676 A * 1/1986 Leininger ..... 345/472
5,402,148 A * 3/1995 Post et al. ..... 345/698
5,565,897 A * 10/1996 Kikinis et al. ..... 345/213
5,975,705 A 11/1999 Lee ..... 353/31
6,304,253 B1 10/2001 Sung et al. ..... 345/187
2003/0006981 A1 * 1/2003 Santou ..... 345/213

* cited by examiner

*Primary Examiner*—Richard Hjerpe
*Assistant Examiner*—Ke Xiao
(74) *Attorney, Agent, or Firm*—George O. Saile; Stephen B. Ackerman

(57) ABSTRACT

The present invention relates to display adjustment and balance methods for liquid crystal displays, LCDs. A wide-range display position adjustment method is described. Compared with the prior art liquid crystal display controllers, the embodiments of this invention are not limited by the width of the vertical and horizontal front and back porch regions of the timing diagrams. These porch values are a function of the display chip technology. The display location control of this invention is independent of the limits of the front and back porch times. The embodiments of this invention facilitate the design of a display position control circuit which allows the image display to be rolled around anywhere on the panel.

40 Claims, 6 Drawing Sheets

FIG. 2 – Prior Art

FIG. 3 – Prior Art

WIDE-RANGE AND BALANCED DISPLAY POSITION ADJUSTMENT METHOD FOR LCD CONTROLLER

BACKGROUND OF THE INVENTION

1. Field of the Invention

The present invention generally relates to display adjustment and balance methods for liquid crystal displays, LCDs. More particularly, a wide-range display position adjustment method is described. More particularly, this adjustment method allows the valid image to be moved to any position in the vertical or horizontal direction on the LCD panel and can even be rolled around.

2. Description of the Prior Art

FIG. 1 shows a basic display description of the prior art. A display 110 is shown. Its resolution is 800 by 600 or 800 pixels horizontally by 600 lines vertically. Also shown is a basic display timing diagram. The Hsync signal 120, which is active when the signal goes to zero, is shown. Also shown is the data enable, DE, signal 130, which is active when DE goes high. The two dotted lines at 140 and 150 show where DE rises and falls respectively. The dotted lines are extrapolated to the Hsync waveform to show the DE transitions in relation to the active Hsync times. The DE 130 signal denotes when the display data is enabled and active on the display screen.

FIG. 2 shows the vertical display control signals in more detail. The main vertical sync signal Vsync 210 is shown. It is active when the signal is at the low level 265. The Vsync signal is used to synchronize the ends of one screen refresh and the start of the next screen refresh. FIG. 2 shows the rising edge of Vsync at 260 and the falling edge of Vsync at 295. The Vtotal parameter is shown 250. It denotes the number of displayable lines on the display. These lines are distributed vertically. FIG. 2 also shows the Hsync signal 220. During the Vtotal time period, the number of Hsync pulses equals the number of horizontal lines, plus the number of Hsync pulses that occur during the Vsync time. FIG. 2 shows these video signals red, green, blue, R, G, B 230. The Vsize parameter 290 indicates how many displayable scan lines appear on the display. Also shown in FIG. 2 is the vertical front porch parameter, Vfp 280. The vertical front porch is that portion of time between the end of the displayable lines and the beginning of the active Vsync, which is when Vsync falls. The end of the displayable lines is denoted by the fall 285 of the Line Enable LE signal 240. There are no displayable lines during the Vfp. The vertical back porch, Vbp 270 is the time period between the rise of the Vsync 260 signal and the rise 275 of the LE signal 240. There are no displayed lines during the Vbp.

FIG. 3 shows the horizontal display control signals in more detail. The horizontal sync signal is Hsync 310 is shown. It is active when the signal is a low level 345. The Hsync signal is used to synchronize the end of one display line and the start of the next display line. FIG. 3 shows the rising edge of Hsync at 340 and the falling edge of Hsync 355. FIG. 3 also shows the three video signals red, green, and blue, RGB, 320. Also shown in FIG. 3 is the Data Enable signal, DE 330. When DE 330 is high & active, pixels are being updated and displayed on the display. FIG. 3 shows the horizontal backporch, Hbp 350. This is the time period between the rise 340 of Hsync 310 and the rise 335 of the DE 330 signal. There is no updating of pixels on the screen during this time period. Also shown is the horizontal frontporch Hfp 360. This is the time period between the fall of DE 330 and the fall of Hsync 355. There is no updating of pixels on the screen during this time period. The Hsize or horizontal size parameter 370 indicates how many displayable pixels appear on the display horizontally.

U.S. Pat. No. 6,304,253 (Sung, et al.) "Horizontal Position Control Circuit for High Resolution LCD Monitors" describes a horizontal position control circuit for liquid crystal displays.

U.S. Pat. No. 5,975,705 (Lee) "LCD Position Determination Apparatus for LCD Projector" describes a position determination apparatus for a liquid crystal display projector.

SUMMARY OF THE INVENTION

It is therefore an object of the present invention to provide a display adjustment and balance method. It is further an object of this invention to achieve a wide-range display position adjustment method. It is further an object of this invention to produce a method which allows the programming of the range of both the horizontal position, H_pos and the vertical position, V_pos to [1, Hsize] and [1, Vsize] respectively. It is further an object of this invention to produce a method which allows the valid display image to be moved around on the screen.

The objects of this invention are achieved by a wide-range and balanced display position adjustment method for the vertical position of a liquid crystal display, LCD controller made up of the steps of including a vertical sync Vsync signal, including the video data signals red, blue, and green R, G, B, including a vertical sync prime signal, Vsync', including a vertical sync double prime signal, Vsync", and including a line enable LE signal.

As in the prior art, use the Vsync trailing edge as an original reference point, and use Hsync as a clock unit. Vsync is used to generate a new Vsync, named Vsync prime or Vsync' whose rising edge is delayed by x Hsync units from the rising edge of Vsync. Usually x=0.5 of Vtotal to create a balanced appearance on the display panel. Next, Vsync' is used as a reference signal to generate a second reference signal called Vsync double prime or Vsync". The rising-edge of Vsync" occurs a programmable number of Hsync units after the rising edge of Vsync'. This programmable parameter is V_pos or Vertical position. Finally, the objective is to position the Line Enable signal or LE to control the actual vertical position or enabling of vertical video on the screen. The LE signal will rise up at a parameter number of Hsync unit delay after the rise of Vsync". This parameter is V_preamble. The fall of the LE signal will occur at a delay of V_preamble+Vactive after the rise of Vsync, where Vactive=Vtotal−Vpulse width−Vbp−Vfp.

Similarly, as in the vertical timing case, use the Hsync trailing edge as an original reference point, and use the pixel clock as a clock unit. Hsync is used to generate a new Hsync, named Hsync prime or Hsync' whose rising edge is delayed by y pixel clock units from the rising edge of Hsync. Usually y=0.5 of Htotal to create a balanced appearance on the display, panel. Next, Hsync' is used as a reference signal to generate a second reference signal called Hsync double prime or Hsync". The rising edge of Hsync" occurs a programmable number of pixel clock units after the rising edge of Hsync'. This programmable parameter is H_pos or Horizontal position. Finally, the objective is to position the Data Enable signal or DE to control the actual horizontal position or enabling of horizontal video on the screen. The DE signal will rise up at a parameter number of pixel clock unit delay after the rise of Hsync". This parameter is H_preamble. The fall of the DE signal will occur at a delay of H_preamble+Hactive after the rise of Hsync, where Hactive=Htotal−Hpulsewidth−Hbp−Hfp The horizontal and vertical timing methods described above for this invention allows the valid display image to be moved around on the screen. This produces a wide-range and balanced display position adjustment for LCD controllers.

The above and other objects, features and advantages of the present invention will be better understood from the following detailed description taken in conjunction with the accompanying drawings.

DESCRIPTION OF THE PREFERRED EMBODIMENT

Figure 4:
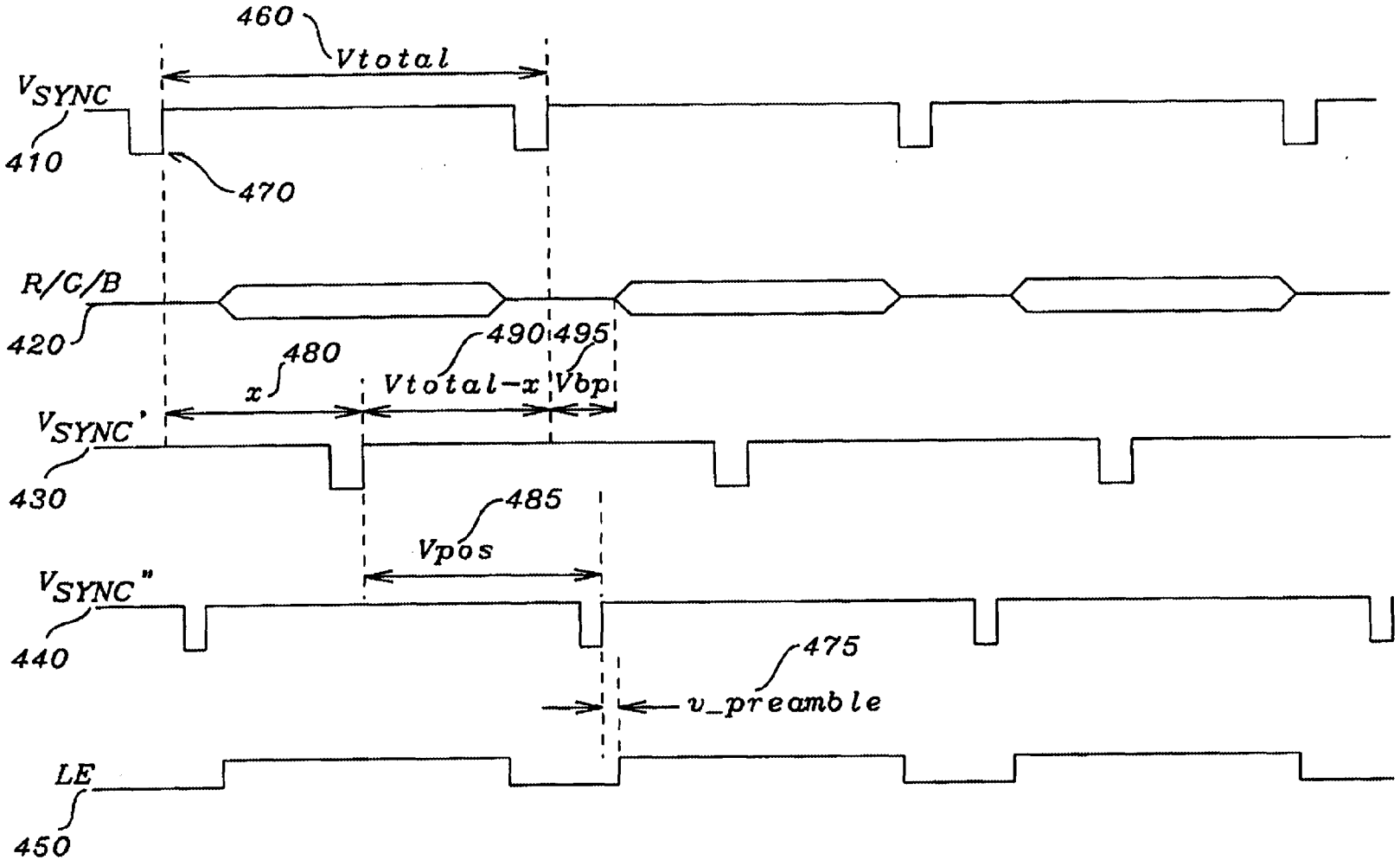
FIG. 4 shows a horizontal timing diagram of this invention.

FIG. 4 shows the timing waveforms, which describes the vertical part of the method of the main embodiment of this invention. The method is explained by using the Vsync as an original reference point and using Hsync as a clock unit. The main vertical sync signal 410 is shown. It is active in the low state. The Vtotal 460 parameter is used to label the period of Vsync in FIG. 4. Next, the Red, Green, and Blue (R, G, B) video data out signals 420 are shown.

The vertical sync prime or Vsync' 430 signal is a key element of this invention. As shown in FIG. 4, the rise of Vsync' is delayed to the rise of Vsync by a time period equal to x 480. Usually x=0.5 Vtotal for balance. The time period from the rise of Vsync' to the rise of Vsync equals (Vtotal−x) 490. The vertical backporch, Vbp 495 is shown. It is the distance from the rise of Vsync to the rise of LE, Line Enable. There are no updates to the display pixels during the Vbp, backporch period.

Next, the vertical sync double prime signal, Vsync" 440 is shown. The rise of Vsync" trails the rise of Vsync' by the value stored in the V-pos parameter 485, as shown in FIG. 4. The line enable, LE, signal 450 is shown in FIG. 4. The rise of LE 450 trails the rise of Vsync" by a parameter called the V_preamble 475.

Figure 1:
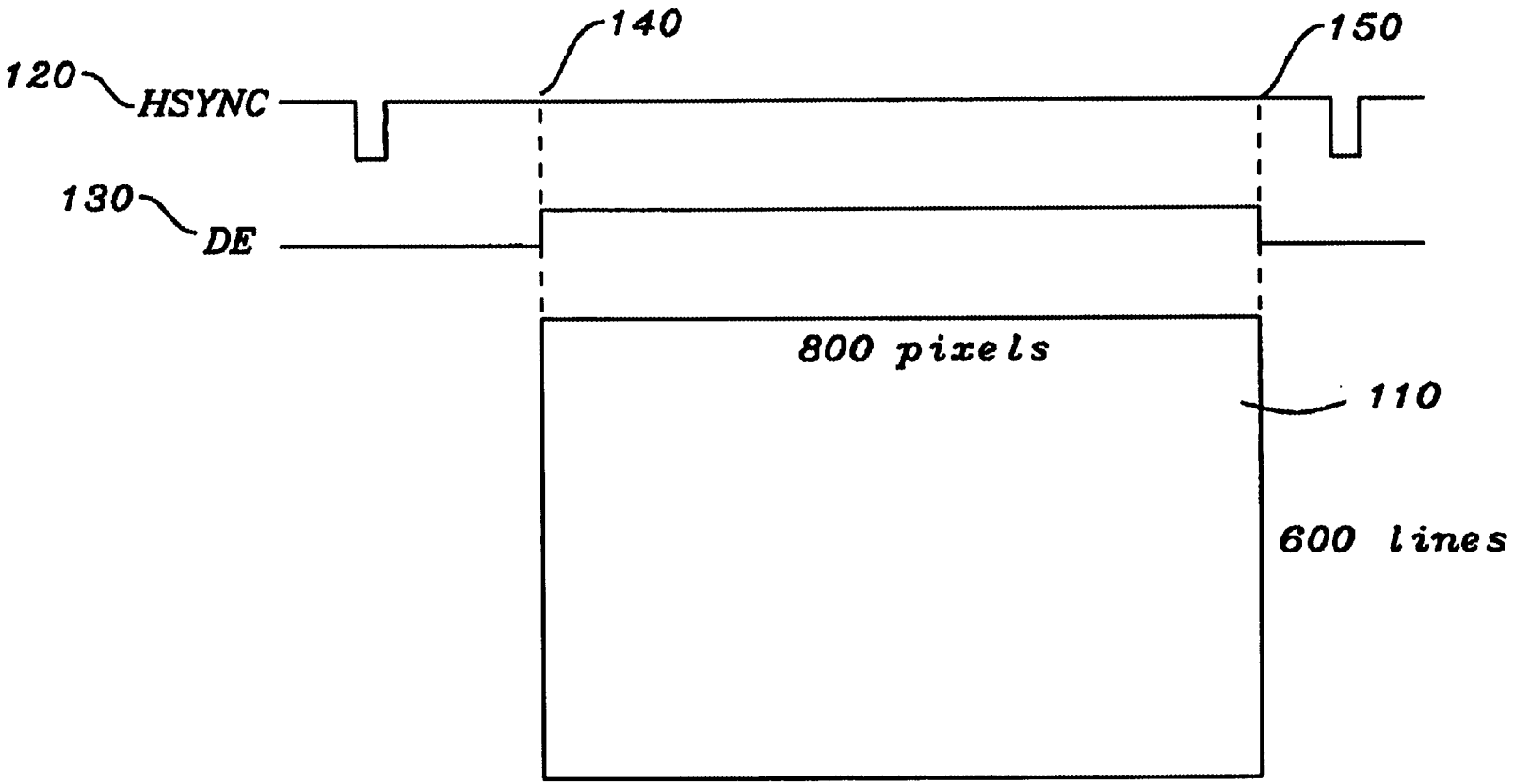
FIG. 1 shows a prior art screen diagram and timing diagram.
Figure 2:
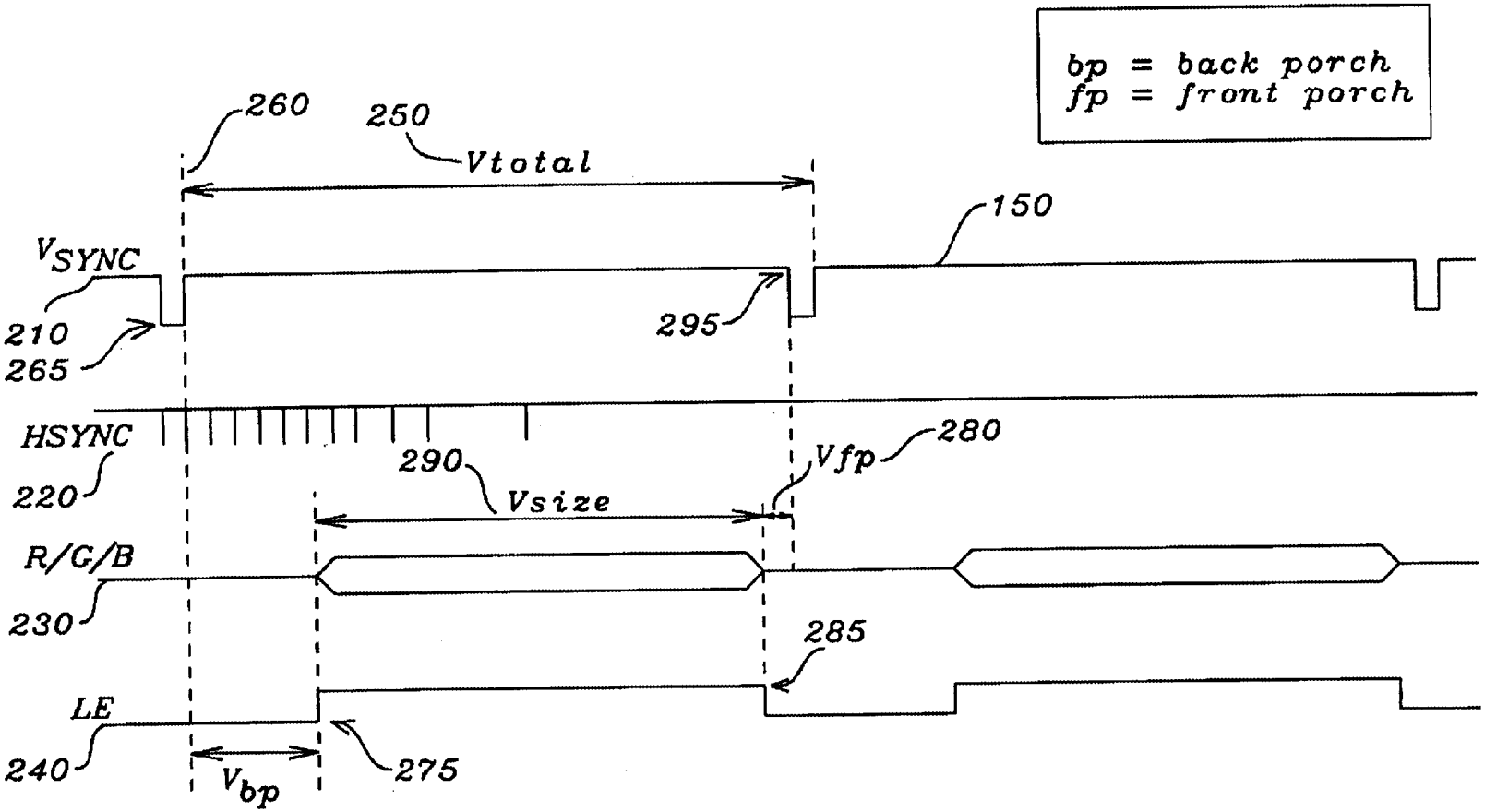
FIG. 2 is a prior art vertical timing diagram illustrating the vertical front porch and the vertical back porch.
Figure 3:
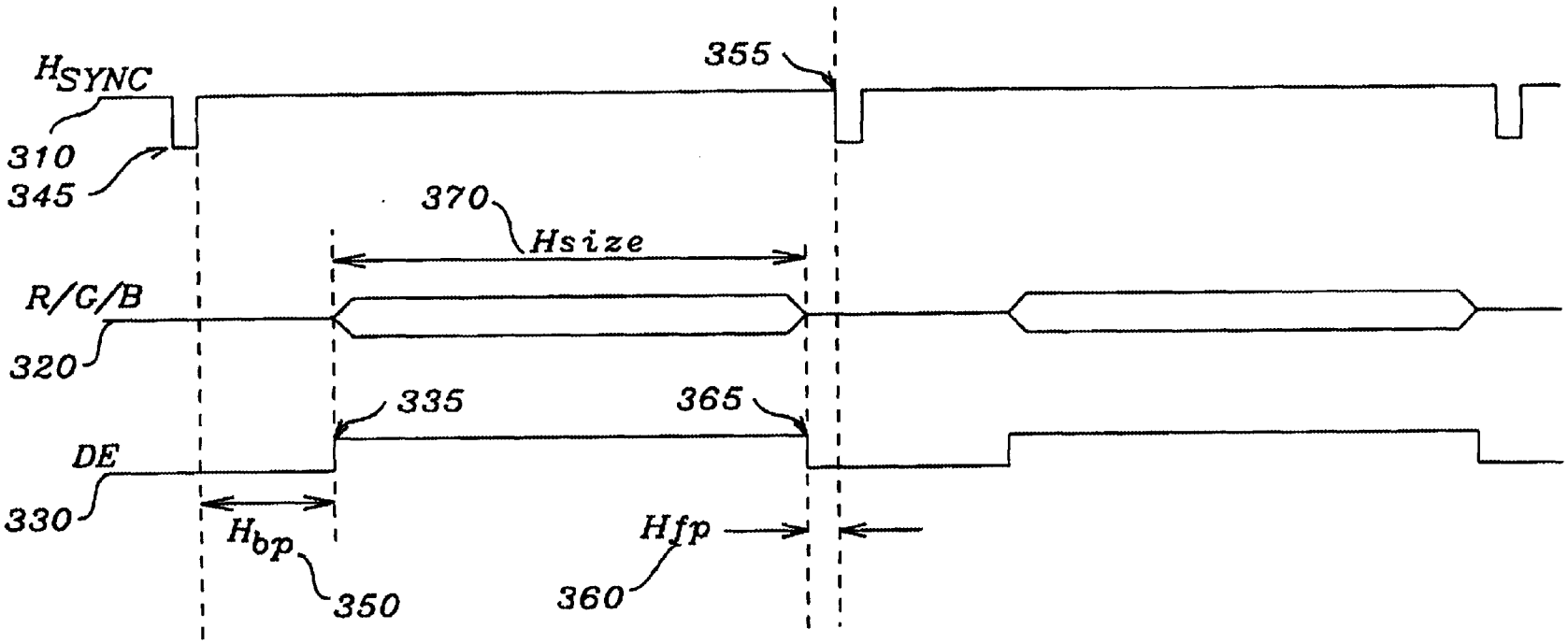
FIG. 3 is a prior art horizontal timing diagram illustrating the horizontal front porch and the horizontal back porch.

To program V_pos as any integer value in the set [1, Vsize], the valid image can be moved to any position in the vertical direction on the LCD panel and can even be rolled around. The valid image can be moved to any vertical position by shifting the rising edge of the LE signal to an earlier or later position between the two Vsync' pulse intervals 496. The LE high level period is always kept as Vsize (Vactive). The freedom of LE produced by this work, related to R/G/B signal is much wider than that produced by the conventional method of FIG. 2 (240). This is the reason why the wide-range position adjustment target can be achieved. LE is limited between Vsync pulses only. The perfect fit value of V-pos is given by $$V_pos=(Vtotal-x+Vstart-V_preamble).$$

When Vstart=Vbp+1, it can generate a perfect fit LE for the R/G/B signal, that is, an LCD panel with a perfect fit vertical position. To get a most wide-range position adjustment, the V_preamble is as small as possible.

Figure 6:
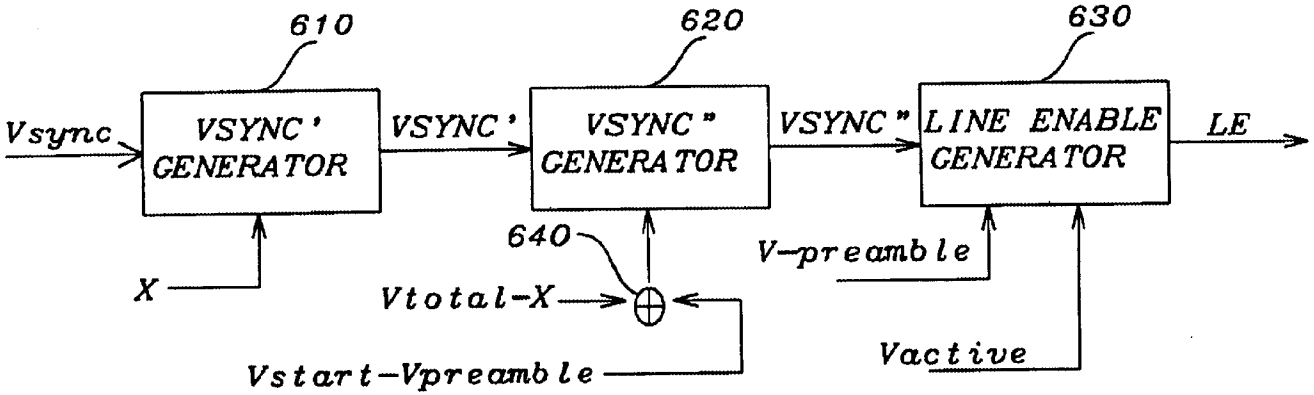
FIG. 6 shows a Vsync block diagram of this invention.

FIG. 6 shows a block diagram of the system used to generate 610 the primary vertical sync signal, Vsync', using the 'x' parameter mentioned above. It also shows the generation 620 of the secondary vertical sync signal, Vsync" via a summation 640 of Vtotal−x and Vstart−Vpreamble. This summation 640 result is called V_pos, vertical position. Next, the Line Enable, LE signal is generated 630 using V_preamble and Vactive.

Figure 5:
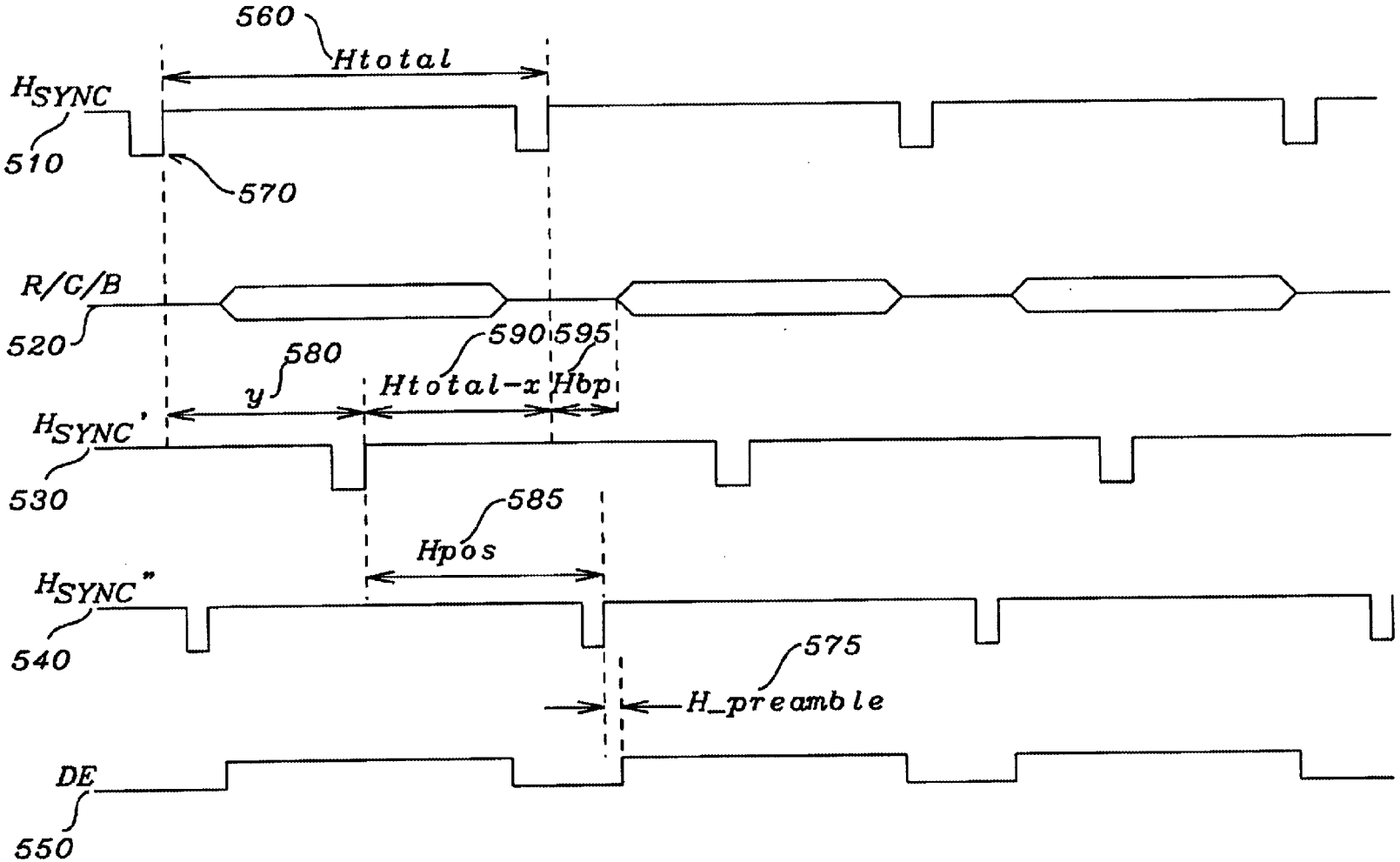
FIG. 5 shows a vertical timing diagram of this invention.

FIG. 5 shows the timing waveforms, which describes the horizontal part of the method of the main embodiment of this invention. The method is explained by using the rise of the Hsync as an original reference point and using the pixel clock as a clock unit. The main horizontal sync signal 510 is shown. It is active in the low state. The Htotal 560 parameter is used to label the period of Hsync in FIG. 5. Next, the Red, Green, and Blue (R, G, B) video data out signals 520 are shown.

The main horizontal sync prime or Hsync' 530 signal is a key element of this invention. As shown in FIG. 5, the rise of Hsync' is delayed to the rise of Hsync by a time period equal to y 580. Usually y=0.5 Htotal for balance. The time period from the rise of Hsync' to the rise of Hsync equals (Htotal−y) 590. The horizontal backporch, Hbp 595 is shown. It is the distance from the rise of Hsync to the rise of DE, data enable. There are no updates to the display pixels during the Hbp, backporch period.

Next, the main horizontal sync double prime signal, Hsync" 540 is shown. The rise of Hsync" trails the rise of Hsync' by the value stored in the H-pos parameter 585, as shown in FIG. 5. The data enable, DE, signal 550 is shown in FIG. 5. The rise of DE 550 trails the rise of Hsync" by a parameter called the H_preamble 575.

To program H_pos as any integer value in the set [1, Hsize], the valid image can be moved to any position in the horizontal direction on the LCD panel and can even be rolled around. The valid image can be moved to any horizontal position by shifting the rising edge of the DE signal to an earlier or later position between the two Hsync' pulse intervals 596. The DE high level period is always kept as Hsize (Hactive). The freedom of DE produced by this work, related to RIG/B signal is much wider than that produced by the conventional method of FIG. 2 (240). This is the reason why the wide-range position adjustment target can be achieved. DE is limited between Hsync pulses only.

The perfect fit value of H-pos is given by $$H_pos=(Htotal-y+Hstart-H_preamble).$$

Hstart is a variable and determines the horizontal position of the image on an LCD panel. When Hstart=Hbp+1, it can generate a perfect-fit DE for the R/G/B signal, that is, an LCD panel with a perfect-fit horizontal position.

Figure 7:
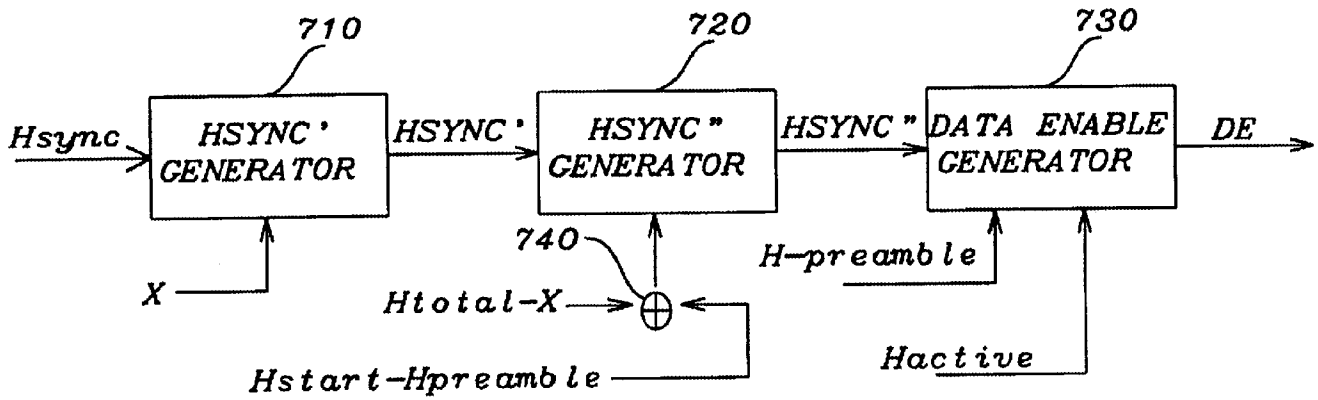
FIG. 7 shows an Hsync block diagram of this invention.

FIG. 7 shows a block diagram of the system used to generate 710 the primary horizontal sync signal, Hsync', using the 'y' parameter mentioned above. It also shows the generation 720 of the secondary horizontal sync signal, Hsync" via a summation 740 of Htotal−y and Hstart−Hpreamble. This summation 740 result is called H_pos, horizontal position. Next, the Data Enable, DE signal is generated 730 using H_preamble and Hactive.

Compared with the prior art liquid crystal display controllers, the embodiments of this invention are not limited by the width of the vertical and horizontal front and back porch regions of the timing diagrams. These porch values are a function of the display chip technology. The display location control of this invention is independent of the limits of the front and back porch times. The embodiments of this invention facilitate the design of a display position control circuit which allows the image display to be rolled around anywhere on the panel.

While the invention has been described in terms of the preferred embodiments, those skilled in the art will recognize that various changes in form and details may be made without departing from the spirit and scope of the invention.

What is claimed is:

1. A wide-range and balanced display position adjustment method for the vertical position of a liquid crystal display, LCD controller comprising the steps of:

providing a main vertical sync signal which synchronizes an end of the periodic access of a display panel for reading and writing, providing video data signals which represent the color information, red, blue, and green which activate a panel display at required locations on said display panel, providing a primary vertical sync signal which is a reference signal offset from the main vertical sync signal, providing a secondary vertical sync signal, which is a reference signal offset from the primary vertical sync signal, and providing a line enable signal which is offset from the secondary vertical sync signal and defines when the video data signals can be active on the display panel.

2. The wide-range and balance display position adjustment method of claim 1 wherein said main vertical sync signal determines the end of the vertical display after a period of a total vertical time.

3. The wide-range and balance display position adjustment method of claim 1 wherein said video data determines when the red, green, blue bits are active vertically on the display.

4. The wide-range and balance display position adjustment method of claim 1 wherein said primary vertical sync signal is delayed by x horizontal sync periods from main vertical sync signal.

5. The wide-range and balance display position adjustment method of claim 1 wherein said secondary vertical sync signal's trailing edge is generated from the trailing edge of said primary vertical sync signal by a programmable vertical sync delay parameter related to vertical image position.

6. The wide-range and balance display position adjustment method of claim 1 wherein said line enable is generated with the rise of said secondary vertical sync signal as a reference point where said line enable signal rises up at a vertical preamble parameter from the rise of said secondary vertical sync signal.

7. The wide-range and balance display position adjustment method of claim 1 wherein said line enable signal falls down at said vertical preamble and a total active vertical time from the rise of said secondary vertical sync signal.

8. The wide-range and balance display position adjustment method of claim 1 wherein said total active vertical time parameter stores the value of the number of horizontal sync pulses in an active vertical time period.

9. The wide-range and balance display position adjustment method of claim 1 wherein a vertical back porch is a time period from de-activation (rise of) of said main vertical sync signal to the rise of said line enable signal.

10. The wide-range and balance display position adjustment method of claim 1 wherein a vertical front porch is a time from deactivation (fall of) of said line enable signal to the fall or activation of said main vertical sync signal.

11. The wide-range and balance display position adjustment method of claim 1 wherein a vertical position parameter is a measure of a number of horizontal sync signals between the rise of said primary vertical sync signal and the rise of said secondary vertical sync signal.

12. The wide-range and balance display position adjustment method of claim 1 wherein a parameter x is chosen to be in the range from a beginning of a vertical time period to the end of said vertical time period, but can be chosen to be 0.5 of a total vertical time parameter so as to result in a balanced display appearance.

13. The wide-range and balance display position adjustment method of claim 1 wherein a perfect fit line enable signal results when said vertical position equals a total vertical time minus a x value plus a vertical back porch minus a vertical preamble time.

14. A wide-range and balanced display position adjustment method for the horizontal position of a liquid crystal display, LCD controller comprising the steps of:

providing a main horizontal sync signal which synchronizes the end of the periodic access of the display panel for reading and writing, providing video data signals which represent the color information, red, blue, and green which activate the panel display at the required locations on said display panel, providing a primary horizontal sync signal which is a reference signal offset from the main horizontal sync signal, providing a secondary horizontal sync signal, which is a reference signal offset from the primary horizontal sync signal, and providing a data enable signal which is offset from the secondary horizontal sync signal and defines when the video data signals can be active on the display panel.

15. The wide-range and balance display position adjustment method of claim 14 wherein said main horizontal sync signal determines the end of horizontal display after a period of a total horizontal time.

16. The wide-range and balance display position adjustment method of claim 14 wherein said video data determines when the red, green, blue bits are active horizontally on the display.

17. The wide-range and balance display position adjustment method of claim 14 wherein said primary horizontal sync signal is delayed by y pixel clock periods.

18. The wide-range and balance display position adjustment method of claim 14 wherein said secondary horizontal sync signal's trailing edge is generated from the trailing edge of said primary horizontal sync signal by a programmable horizontal sync delay parameter related to horizontal image position.

19. The wide-range and balance display position adjustment method of claim 14 wherein said data enable is generated with the rise of said secondary horizontal sync signal as a reference point where said data enable signal rises up at a horizontal preamble parameter from the rise of said secondary horizontal sync signal.

20. The wide-range and balance display position adjustment method of claim 14 wherein said line enable signal falls down at said horizontal preamble and a total active horizontal time from the rise of said secondary horizontal sync signal.

21. The wide-range and balance display position adjustment method of claim 14 wherein said total active horizontal time parameter stores the value of the number of pixel clock pulses in an active horizontal time period.

22. The wide-range and balance display position adjustment method of claim 14 wherein a horizontal back porch is a time period from de-activation (rise of) of said horizontal sync signal to the rise of said data enable signal.

23. The wide-range and balance display position adjustment method of claim 14 wherein a horizontal front porch is a time from deactivation (fall of) of said data enable signal to the fall or activation of said main horizontal sync signal.

24. The wide-range and balance display position adjustment method of claim 14 wherein a horizontal position parameter is a measure of a number of pixel clock pulses between the rise of said primary horizontal sync signal and the rise of said secondary horizontal sync signal.

25. The wide-range and balance display position adjustment method of claim 14 wherein a parameter y is chosen to be in the range from a beginning of a horizontal time period to the end of said horizontal time period, but can be chosen to be 0.5 of a total horizontal time parameter so as to result in a balanced display appearance.

26. The wide-range and balance display position adjustment method of claim 14 wherein a perfect fit data enable signal results when said horizontal position equals a total horizontal time minus a y value plus a horizontal back porch minus a horizontal preamble time.

27. A system for producing a wide-range and balanced display position adjustment for the vertical position of a liquid crystal display, LCD controller comprising:

a means for providing a main vertical sync signal which synchronizes an end of periodic access of a display panel for reading and writing, a means for providing color video data signals red, blue, and green which activate a panel display at required locations on said display panel, a means for providing a primary vertical sync signal which is a reference signal offset from said main vertical sync signal, a means for providing a secondary vertical sync signal which is a reference signal offset from said primary vertical sync signal, and a means for providing a line enable signal which is a reference signal offset from the secondary vertical sync signal and defines when the video data signals can be active on the display panel.

28. The system for producing a wide-range and balance display position adjustment method of claim 27 wherein said main vertical sync signal determines an end of the vertical display after a period of a total vertical time.

29. The system for producing a wide-range and balance display position adjustment method of claim 27 wherein said video data determines when the red, green, blue bits are active vertically on the display.

30. The system for producing a wide-range and balance display position adjustment method of claim 27 wherein said primary vertical sync signal is delayed by x horizontal sync periods.

31. The system for producing wide-range and balance display position adjustment method of claim 27 wherein said secondary vertical sync signal's trailing edge is generated from the trailing edge of said primary vertical sync signal by a programmable vertical sync delay parameter related to vertical image position.

32. The system for producing a wide-range and balance display position adjustment method of claim 27 wherein said line enable is generated with the rise of said secondary vertical sync signal as a reference point where said line enable signal rises up at a vertical preamble parameter from the rise of said secondary vertical sync signal.

33. The system for producing a wide-range and balance display position adjustment method of claim 27 wherein said line enable signal falls down at said vertical preamble and a total active vertical time from the rise of said secondary vertical sync signal.

34. A system for producing a wide-range and balanced display position adjustment method for the horizontal position of a liquid crystal display, LCD controller comprising:

a means for providing a main horizontal sync signal which synchronizes an end of the periodic access of a display panel for reading and writing, a means for providing color video data signals red, blue, and green which activate a panel display at required locations on said display panel, a means for providing a primary horizontal sync signal which is a reference signal offset from said main horizontal sync signal, a means for providing a secondary horizontal sync signal which is a reference signal offset from said primary horizontal sync signal, and a means for providing a data enable signal which is a reference signal offset from the secondary vertical sync signal and defines when the video data signals can be active on the display panel.

35. The system for producing a wide-range and balance display position adjustment method of claim 34 wherein said main horizontal sync signal determines an end of horizontal display after a period of a total horizontal time.

36. The system for producing a wide-range and balance display position adjustment method of claim 34 wherein said video data determines when the red, green, blue bits are active horizontally on the display.

37. The system for producing a wide-range and balance display position adjustment method of claim 34 wherein said primary horizontal sync signal is delayed y pixel clock periods.

38. The system for producing a wide-range and balance display position adjustment method of claim 34 wherein said secondary horizontal sync signal's trailing edge is generated from the trailing edge of said primary horizontal sync signal by a programmable horizontal sync delay parameter related to horizontal image position.

39. The system for producing a wide-range and balance display position adjustment method of claim 34 wherein said data enable is generated with the rise of said secondary horizontal sync signal as a reference point where said data enable signal rises up at a horizontal preamble parameter from the rise of said secondary horizontal sync signal.

40. The system for producing a wide-range and balance display position adjustment method of claim 34 wherein said data enable signal falls down at said horizontal preamble and a total active horizontal time from the rise of said secondary horizontal sync signal.

* * * * *